United States Patent [19]

Lippitt, Jr. et al.

[11] Patent Number: 4,503,565

[45] Date of Patent: Mar. 12, 1985

[54] MEMBRANE VALVE FOR DRY DIVER'S APPAREL

[75] Inventors: Maxwell W. Lippitt, Jr.; Marshall L. Nuckols, both of Panama City, Fla.

[73] Assignee: The United States of America as represented by the Secretary of the Navy, Washington, D.C.

[21] Appl. No.: 467,428

[22] Filed: Feb. 17, 1983

[51] Int. Cl.[3] ..... B63C 11/08; B63C 11/02

[52] U.S. Cl. ..... 2/2.1 R; 128/201.27; 128/201.28; 405/186

[58] Field of Search ..... 2/2.1 R, 2.1 A, 158, 2/159, 161 R, 161 A; 128/201.27, 201.28; 405/186, 185, 193

[56] References Cited

U.S. PATENT DOCUMENTS

| | | | |
|---|---|---|---|
| 2,593,988 | 4/1952 | Cousteau | 128/144 |
| 2,989,752 | 6/1961 | Sloane et al. | 2/2.1 |
| 3,026,522 | 3/1962 | Di Julio | 2/2.1 |
| 3,428,960 | 2/1969 | Schueller | 2/2.1 R |
| 4,234,637 | 11/1980 | Sewell et al. | 428/131 |
| 4,403,608 | 9/1983 | Warncke | 2/2.1 A X |

FOREIGN PATENT DOCUMENTS

| | | | |
|---|---|---|---|
| 2038187 | 7/1980 | United Kingdom | 405/186 |

*Primary Examiner*—Werner H. Schroeder
*Assistant Examiner*—J. L. Kravitz
*Attorney, Agent, or Firm*—Robert F. Beers; Harvey A. David

[57] ABSTRACT

A water excluding vent valve for insulated gloves or other portions of a diver's dry suit utilizes a vent control element including a microporous membrane disposed in obturating relation to an opening in the shell of the glove or other article. The membrane is laminated between protective layers of woven synthetic fabric, and a retaining means permitting replacement of the control element is described.

13 Claims, 3 Drawing Figures

MEMBRANE VALVE FOR DRY DIVER'S APPAREL

BACKGROUND OF THE INVENTION

This invention relates to the field of dry diving suits or apparel, and more particularly to improvements in venting valves or devices forming part thereof.

Dry suits are those that maintain a dry interior. They are preferred in those instances where thermal protection is most needed and is achieved by insulative liners that become less effective when wet. Such suits often include removable, thermally protective gloves that likewise are intended to remain dry.

Ideally, when a dry suited diver is at a given depth, the ambient pressure on each portion of the suit is balanced by a like pressure within, with the volume of the suit and its gloves adjusted for comfort, mobility, and buoyancy. When the diver ascends to a shallower depth, the ambient pressure decreases relative to the suit interior and, unless vented, the interior gas tends to expand the suit and its gloves with resultant undesirable increases in volume and buoyancy and, in some cases, blowing off of the diver's gloves.

Diving suits or apparel have long been provided with vent valves positioned at various locations for the purpose of venting excess gas from the suit proper or from certain zones thereof, such as gloves, so as to maintain a constant volume while excluding entry of water into the suit or zones served by the valves. U.S. Pat. Nos. 2,593,988 and 3,026,522 describe representative prior art valves and the use thereof. In general such valves have comprised flexible rubber valve elements, or spring biased elements that yield to expansion of gas due to pressure differentials during ascent and that close to seal out water during descent when ambient pressures increase. Such valves have been subject to water leakage in that they have been prone to become fouled by sand or mud, or when they have been allowed to accumulate salt crystals from prior use without subsequent cleaning or flushing with fresh water. Such leakage of water, for example into gloves of the dry type, can be a great disadvantage, particularly when protecting the diver against cold temperatures is a factor. When water gets into the liners of gloves, boots, or other suit portions it materially reduces the insulating value thereof, and the diver's ability to work, or even survive, in extremely cold conditions is impaired.

U.S. Pat. No. 4,234,637 discloses a microporous protective film formed of non-water soluble, non-skin-toxic material for use in protective garments including diver's suits, the porosity of the film permitting the passage of body vapors but preventing, at least up to modest pressures, the counter-passage of water. That patent contemplates the use of such material to form diver's wet suits, having the advantage of being more comfortably worn out of the water than are conventional wet suits.

SUMMARY OF THE INVENTION

With the foregoing in mind, it is a principal object of this invention to provide, in a diver's suit or item of diver's apparel such as a thermally protective glove, an improved excess gas venting device that is operative to vent gas at pressures above ambient water pressure so as to maintain a substantially constant volume while keeping the apparel interior substantially dry.

Another object of the invention is the provision of a thermally protective diving glove having an improved gas venting and water excluding device that is self regulating as to the flow rate required to maintain a substantially constant volume.

Yet another object is to provide, in a diver's suit, or portion thereof, a vent device utilizing a vent control element comprising a microporous membrane to vent gas from the interior of the suit or component thereof to the ambient water without the need of any moving parts, springs, or the like.

Still another object is to provide a vent device that is relatively inexpensive, compact, light in weight, and which requires a minimum of servicing.

Other objects and many of the attendant advantages will be readily appreciated as the subject invention becomes better understood by reference to the following detailed description, when considered in conjunction with the accompanying drawings.

DESCRIPTION OF THE PREFERRED EMBODIMENT

Figure 1:
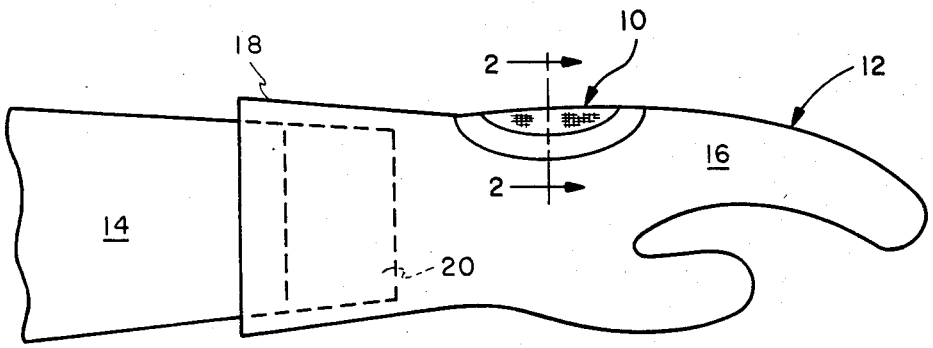
FIG. 1 is a side elevational view of a vented, thermally protective glove component of a diver's dry suit embodying the invention.

Referring to FIG. 1, a venting device of the invention will be described as embodied in a diver's dry glove 12 forming part of a thermally protective, dry diving suit, one sleeve portion of which is indicated at 14. It will, of course, be understood that the venting device 10 can be located in a variety of alternative or other locations on the diving suit, such as on boots, the suit body, or on the leg or sleeve portions thereof. The glove 12 of this example is gauntlet-like and comprises an impervious, hand enclosing shell 16 of flexible rubberized fabric, e.g. neoprene coated nylon, and a frustoconical glove cuff 18 which can be of the same material but is advantageously elastic. The sleeve 14 conveniently terminates in an elastic wrist cuff 20 that prevents entry of water into the sleeve in the absence of the glove but permits gas to enter the glove as necessary during descent to balance increasing ambient pressure. The glove cuff 18 serves to provide a substantially watertight connection between the glove and the sleeve. Additional securing and waterproofing measures can be used, for example adhesive tape (not shown).

Figure 2:
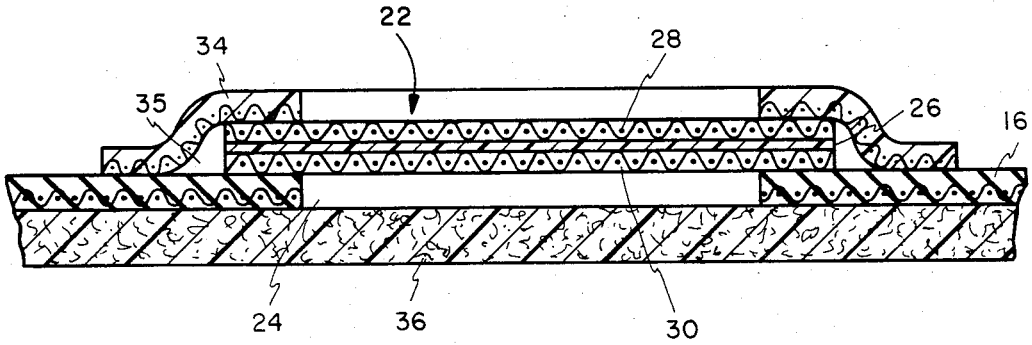
FIG. 2 is a fragmantary sectional view, on an enlarged scale, taken substantially along line 2—2 of FIG. 1.

Turning now to FIG. 2 in which the thickness of certain parts are exaggerated for clarity, the vent device 10 comprises a flexible, disc-shaped vent control element 22 disposed over an opening 24 in the back of the glove shell 16. The vent control disc or element 22 comprises a composite laminated structure including a microporous membrane 26 between outer and inner protective layers 28,30 of a woven fabric of synthetic fiber such as 1000 denier nylon. The membrane 26 is formed of a hydrophobic, chemically inert, synthetic plastic material such as expanded polytetraflouroethylene, that remains stable, flexible, and relatively unaffected by temperature changes throughout a range far exceeding those that would be met in diving situations. The microporous membrane material can be obtained commercially with various porosities and maximum pore sizes selected to effect a desired exhaust or venting flow rate based on the over-pressure of gas on one side with water on the other side. One example of a suitable material is sold under the trade mark "GORTEX" by Gore, Inc. of Elkton, Md. The protective layers 28,30 prevent materials such as skin oils from contacting the mambrane during handling or use where no thermal liner is used.

The composite vent control disc 22 has its peripheral margin overlying, and cemented to the glove shell 16 around opening 24. An annular band 34, conveniently of closed cell neoprene foam material and having an outer diameter somewhat greater than the element 22 and on inside diameter equal to the opening 24, is cemented or bonded to the glove and to the edge portion of the element. The gllue advantageously fills any void 35 and impregnates the edge portion to prevent migration of water around the edge of the membrane.

A thermally insulating glove liner 36 typical of thermally protective gloves, is provided. The liner 36 may be of any suitable material and may be either removable or bonded to the interior of shell 16. In this example the liner 36 comprises a layer of hydrophobic fiber batting, although other materials such as open cell foam urethane material could be used. It is of course necessary to operation of the vent device 10 that a liner such as 36 be pervious to air, at least in the area of the vent.

The pore size and area of the vent control element 22 are selected, of course, to provide a flow rate capability that will accommodate the maximum rate of ascent, volume, and maximum tolerable pressure differential of the glove or other suit portion served, relative to the ambient water.

In this regard, it can be shown that the required actual volumetric flow rate Q in $ft^3$/min at any particular depth D can be expressed as $$Q=(0.445VR)/(14.7+D(0.445),$$

where V is a constant volume in $ft^3$, e.g., of a glove, that is to be served by a vent device 10, R is the rate of ascent in ft/min, and D is the depth in feet of sea water. A typical rate of ascent is 60 ft/min, with a maximum safe rate being 100 ft/min. From the above it will be recognized that the required actual flow rate will increase as the diver ascends. Thus, assuming a constant glove volume of 0.03 $ft^3$ (excluding hand), an ascent rate of 100 ft/min, the value for Q at the surface is 0.091 $ft^3$/min. Of course, there will be a slight time lag in the venting so that during ascent there will be a slight pressure differential of about 2 feet of seawater, or something less than 1 psi overpressure in the glove as a flow producing working pressure.

A flow control element 22 having a membrane 26 the pore size of which is in the range of about 1.0 micron to about 3.0 micron can achieve the desired flow rate at the mentioned low pressure differentials while providing water entry pressures of from about 7 psi to about 2 psi.

The water entry pressure of the membrane is an important consideration in that during descent, if the increases in ambient pressure lead increases in pressure within the suit or glove, a negative pressure differential will arise tending to force water inwardly through the vent control element 22.

In experimental tests a vent control element 22 two inches in diameter and membrane pore size of nominally one micron vented gas from an ascending diver's glove at flow rates such that the internal glove pressure would not rise above 0.5 psi above ambient water pressure. No water leaked into the glove during such tests.

Figure 3:
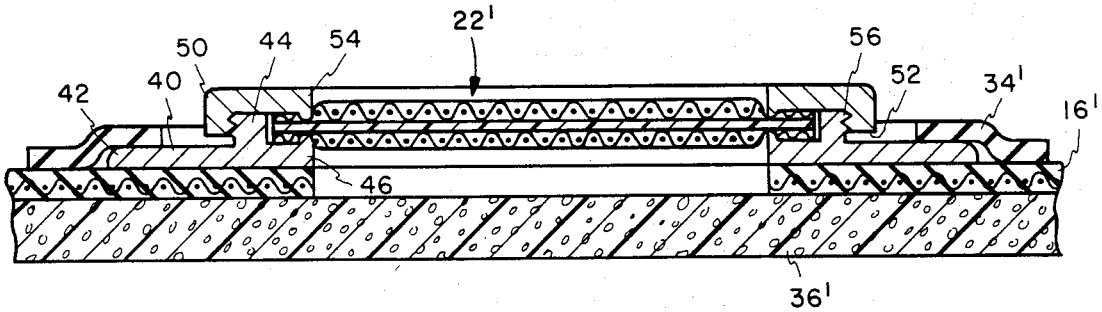
FIG. 3 is a sectional view illustrating an alternative embodiment of the invention.

Referring to FIG. 3, an alternative vent device 10' is provided with capability of removal and replacement of a vent control element 22' similar to the element 22 of the embodiment of FIGS. 1 and 2. In this embodiment an annular, vent control element holder comprises a holder base 40 having a radial outer flange 42, an inner flange 44, and a cylindrical rim or sidewall 46. The base 40 is molded of a tough rigid or semi-rigid plastic material such as nylon, and is bonded to a glove shell 16' around an opening 24'. An annular band 34' is cemented or bonded to the shell 16' and to the flange 42, as shown.

An annular retainer ring 50, also formed of a suitable plastic has a cylindrical rim or side-wall 52 and inwardly directed flange 54 adapted to overlie the peripheral portion of the vent control element 22' resting against the base inner flange 44. The retainer ring 50 is removably connected to the base 40 by cooperating threads on the side-wall 46 and 52 as shown at 56. The flanges 46 and 54 are provided with beads 48 and 58, respectively, that tightly clamp the edge portion of the vent control element 22', which edge portion is advantageously rendered impervious by impregnation with a suitable plastic or rubber material to prevent migration of water around the edge of the membrane.

It will be recognized that the retainer ring 50 and the element 22' can be quickly removed for cleaning or for replacement of the element for example to select a different interior over-pressure to be maintained.

Obviously, other embodiments and modifications of the subject invention will readily come to the mind of one skilled in the art having the benefit of the teachings presented in the foregoing description and the drawing. It is, therefore, to be understood that this invention is not to be limited thereto and that said modifications and embodiments are intended to be included within the scope of the appended claims.

What is claimed is:

1. A vent device in combination with an article of diver's dry suit apparel including a shell of waterproof fabric, said device comprising:

a vent control element comprising a water impervious, microporous membrane of expanded, hydrophobic, synthetic material;

means for securing said vent control element in obturating relation to a vent opening in said shell; and said vent control element being operative to prevent ambient water from entering said article through said opening and to permit venting of gas from said article through said opening when the gas pressure within said article exceeds ambient water pressure outside said article.

2. A vent device as defined in claim 1, and wherein: said vent control element comprises first and second protective layers of woven synthetic fabric bonded to opposite sides of said membrane.

3. A vent device as defined in claim 2, and wherein: said means for securing said vent control element comprises a flexible material bonded to said shell and to the periphery of said element.

4. A vent device as defined in claim 2, and wherein: said means for securing said vent control element comprises an annular holder fixed to said shell around said opening, said holder comprising a base member and a removable member, said members cooperating to releasable clamp the periphery of said vent control element.

5. A vent device as defined in claim 3, and wherein: said membrane comprises expanded polytetraflouroethylene.

6. A vent device as defined in claim 4, and wherein: said membrane comprises expanded polytetraflouroethylene.

7. A vent device as defined in claim 6, and wherein: said base member and said removable member comprise cooperating screw thread means.

8. A vent device as defined in claim 5, and wherein: said vent control element is operative to vent gas during a diver's ascent at such a rate that said gas pressure remains below a predetermined maximum pressure differential relative to said ambient pressure.

9. A vent device as defined in claim 7, and wherein: said vent control element is operative to vent gas during a diver's ascent at such a rate that said gas pressure remains below a predetermined maximum pressure differential relative to said ambient pressure.

10. A vent device as defined in claim 8, and wherein: said article of apparel comprises a diver's glove; and said vent device is disposed on the back of said glove.

11. A vent device as defined in claim 9, and wherein: said article of apparel comprises a diver's glove; and said vent device is disposed on the back of said glove.

12. A vent device as defined in claim 10, and wherein: said microporous membrane has pores in the size range of from about 1.0 micron to about 3.0 micron.

13. A vent device as defined in claim 11, and wherein: said microporous membrane has pores in the range of from about 1.0 micron to about 3.0 micron.

* * * * *